US006598285B1

(12) United States Patent
Binggeli et al.

(10) Patent No.: US 6,598,285 B1
(45) Date of Patent: Jul. 29, 2003

(54) BORDERING AND/OR CREASE-CLOSING MACHINE AND METHOD FOR OPERATING THE SAME

(75) Inventors: Rudolf Binggeli, Wohlen (CH); Slavko Nikolic, Schwarzenburg (CH)

(73) Assignee: Spiro S.A., Fribourg (CH)

( * ) Notice: Subject to any disclaimer, the term of this patent is extended or adjusted under 35 U.S.C. 154(b) by 0 days.

(21) Appl. No.: 09/830,842

(22) PCT Filed: Nov. 4, 1999

(86) PCT No.: PCT/CH99/00520

§ 371 (c)(1),
(2), (4) Date: May 1, 2001

(87) PCT Pub. No.: WO00/27557

PCT Pub. Date: May 18, 2000

(30) Foreign Application Priority Data

Nov. 6, 1998 (EP) ..... 98811110

(51) Int. Cl.[7] ..... B21D 39/00; B21D 39/03; B21D 39/18

(52) U.S. Cl. ..... 29/509; 29/512; 72/86; 72/105; 493/405; 493/443

(58) Field of Search ..... 72/105, 106, 110, 72/86, 87; 29/509, 512; 493/405, 443, 444, 454

(56) References Cited

U.S. PATENT DOCUMENTS 3,015,502 A * 1/1962 Frost et al. ..... 285/112
3,490,137 A 1/1970 Buck et al.
3,541,826 A * 11/1970 Halliburton ..... 72/105
4,006,520 A * 2/1977 Wachter ..... 29/243.517
4,538,334 A * 9/1985 Binggeli ..... 29/243.5
4,692,980 A * 9/1987 Carroll et al. ..... 29/243.518
5,970,767 A * 10/1999 Hartman et al. ..... 72/62
5,979,202 A * 11/1999 Blakeley ..... 72/68
6,041,634 A * 3/2000 McNally ..... 72/105
6,196,039 B1 * 3/2001 Williams et al. ..... 72/105
6,244,088 B1 * 6/2001 Compton ..... 72/105
6,311,379 B1 * 11/2001 Torre et al. ..... 29/243.58

FOREIGN PATENT DOCUMENTS

GB 2 270 021 A 3/1994

* cited by examiner

*Primary Examiner*—Rinaldi I. Rada
*Assistant Examiner*—Hemant M Desai
(74) *Attorney, Agent, or Firm*—Weingarten, Schurgin, Gagnebin & Lebovici LLP

(57) ABSTRACT

Formerly, several machines or workstations have been required for bordering and closing creases, especially on pipes used in ventilation technology. The invention provides a machine that can carry out all of the operations without the workpiece having to be rechecked. By positioning the closing wheel (6), known per se, underneath the work surface, all of the operations, including the insertion of a sealing strip, can be carried out precisely and economically at the same workstation. According to a preferred method, a bead is first pressed in the workpiece (100) using a moulding roll (2) and a beading and feeding roll (1). During machining with these hydromechanically driven rolls (2, 1), the workpiece (100) is held in the correct working position. The closing process is carried out from the bottom and enables optimum adjustment of the angle of intervention on the closing wheel (6) and reduces wear.

19 Claims, 13 Drawing Sheets

BORDERING AND/OR CREASE-CLOSING MACHINE AND METHOD FOR OPERATING THE SAME

The present invention relates to a machine according to the preamble of claim 1 and to a method of flanging/closing and folding/closing.

A folding/closing machine is known inter alia from EP-A-0 104 145 and has proved successful in practice for closing conventional folds for folded connections in pipe-bend segments, in particular in the field of ventilation. In this case the folds are closed over a closing wheel guided in a closing-wheel slide, both being arranged above a support face for the pipe ends. The jointly rotating closing wheel comprises an oblique-angled operating face; in this case the closing-wheel slide is likewise arranged at an oblique angle to the support face.

As a result of the resulting geometrical relationships only simple folded connections can be produced with the known device. More complicated folds, such as are required for the secure clamping of seals, can be manufactured only with difficulty and/or require subsequent treatment. The necessary flanging which precedes the formation of a fold was performed in each case on a separate machine or operating station.

SUMMARY OF THE INVENTION

The object of the present invention is therefore to produce a folding/closing machine which does not have these drawbacks and which allows the producer of seal connections an optimum arrangement of high-quality seals in numerous variants, without the latter being subject to restrictions in their shape and their dimensions on manufacturing grounds. It should thus be possible for improved pipe connections, which can be used in higher-quality types of ventilation or sealing, to be produced in a rational and safe manner in particular in the field of ventilation.

In addition, it should be possible to carry out the flanging on the same machine and the same operating station. It should also be possible for pre-fabricated standard parts, such as connecting rings and sleeves, to be further processed.

The machine to be provided and the corresponding method of folding/closing should be efficient and allow a risk-free operation even by unskilled personnel.

This object is attained by the features of claim 1.

The arrangement of the closing wheel and the closing-wheel slide below the support face, which corresponds to the machine bed, allows almost any flangings and folds to be produced in a risk-free manner.

Advantageous further developments of the subject of the invention are described in the following dependent claims.

A closing-wheel slide provided with a pivot axis can be set to the quality of the metal sheet in an optimum manner and prevents impermissible degrees of wear on the material to be machined and on the closing wheel.

A fixed angle of the closing-wheel slide of from 8° to 12° is particularly suitable for the insertion of seals into the folds, whereas one of from 20° to 30° is used mainly for end folds, without seals.

A closing wheel with an operating face engaging on the flanging over a large area requires only minimal forces and results in only slight wear.

Surprisingly, a design of the lateral faces of the closing wheel bent over in the manner of a plate results in an additionally greatly improved, positively locking clamping even of thick and yielding seals.

A particularly precise and secure guidance of a pipe stub or a ring is provided by a continuous bead which is produced by two mutually opposed concave/convex rollers.

Universal drives save a considerable amount of space; they allow the closing-wheel slide to be accommodated without difficulty in the remaining space.

The arrangement of a plurality of support rollers results in an increase in security, and the quality of the folds is likewise improved by the resulting parallel guidance.

Holding-down means capable of rotation allow rings to be machined safely, even if they do not have a continuous bead or if the latter has to be impressed only subsequently.

It is particularly advantageous to design the machine with shaping rollers which allow bending over in a very simple manner, without the workpiece having to be re-clamped or moved to a different operating station.

Because of their relatively small dimensions and the high torques which can be achieved thereby, hydraulic drives are particularly suitable.

In accordance with the method, rings are clamped on the support face of the machine by jointly rotating holding-down means, and after that a flange-like bending-over is produced by the shaping rollers and is turned over and closed after the insertion of a sealing strip.

Relatively large pipe segments, bend segments and connecting rings with stop beads are advantageously guided on this bead or the latter is produced first. In the simplest way it is impressed by means of a concave beading and delivery roller and a convex support roller cooperating therewith an an opposed manner.

A precise guidance of the workpiece is provided by the beading and delivery roller which engages during the machining and which together with the opposed convex shaping roller prevents displacement.

During closure on the pipe collar it is recommended that the seal should be held down manually or preferably by hydraulically actuated fingers or rollers, depending upon the nature of the seal.

BRIEF DESCRIPTION OF THE DRAWINGS

The subject of the invention is illustrated below by way of example with reference to drawings, in which.

DETAILED DESCRIPTION OF THE DRAWINGS

Figure 1:
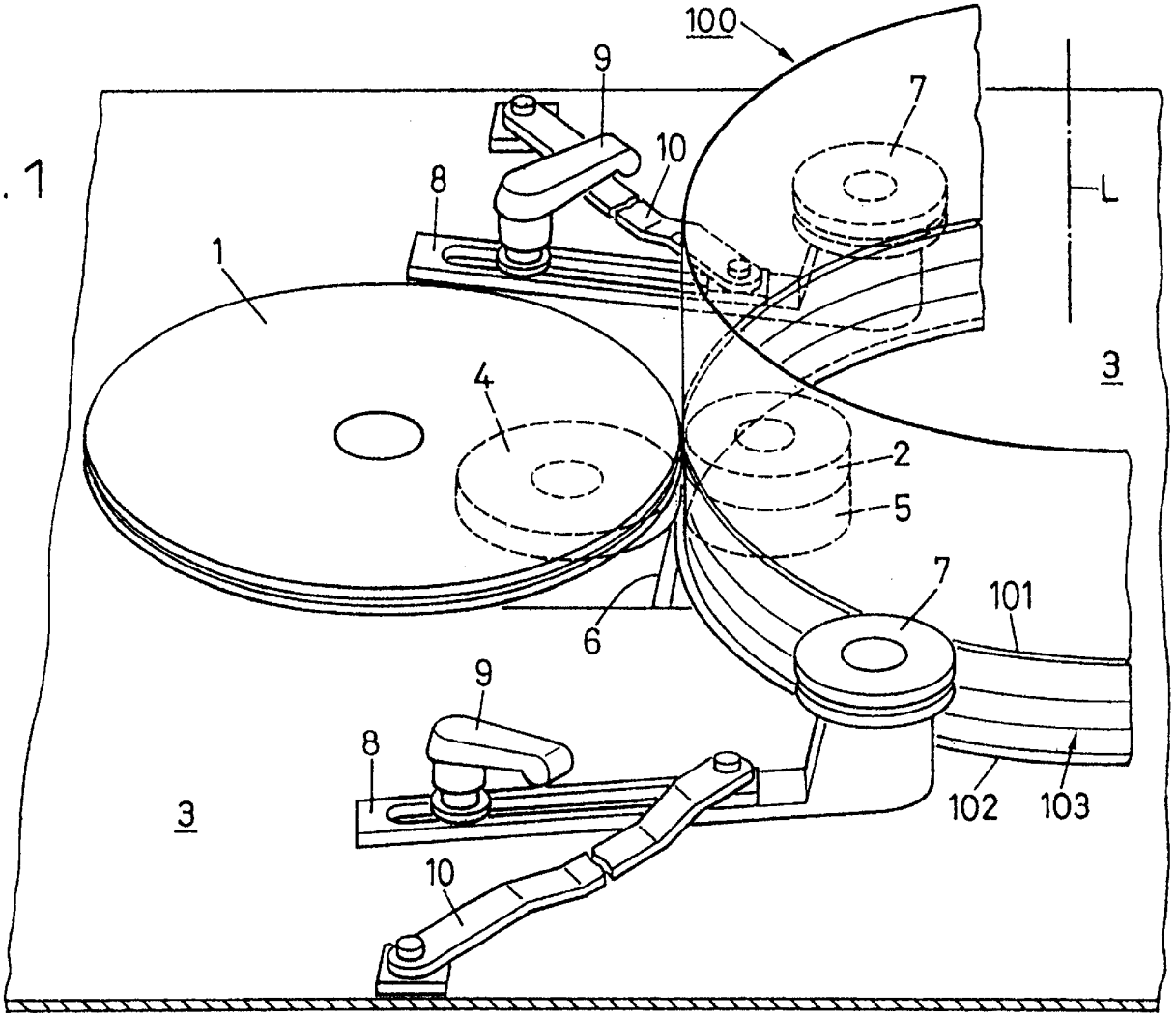
FIG. 1 is a cut-away perspective illustration of a flanging/closing and folding/closing machine in the operation thereof on a pipe stub.

The cut-away perspective illustration of a flanging/closing and folding/closing machine, FIG. 1, shows the machining of a pipe stub 100. In this case the pipe stub 100 is situated with the pipe collar 102 thereof—a flanging—orientated vertically above the support face 3 of the machine bed, this being indicated by the perpendicular L.

In the operation illustrated, a continuous bead 101 is first impressed in the pipe stub 100 by a concave beading and delivery roller 1 which is driven and which presses the pipe member 100 against a convex support roller 2 present in the interior and indicated with a broken line.

Next the flanging 102 is produced by the rollers 4 and 5 likewise indicated with broken lines, the beading and delivery roller 1 providing the parallel guidance.

After a seal (not shown here) is inserted in the region 103, a closing wheel 6 moves from below over the rotating flanging 102 and closes it, so as to form a fold.

Adjustable guiding and pressing rollers 7 capable of rotation are used to guide the pipe stub 100. They are mounted on an angled clamping plate 8 and can be orientated and fixed by means of a clamping lever 9 and a brace 10.

Figure 1A:
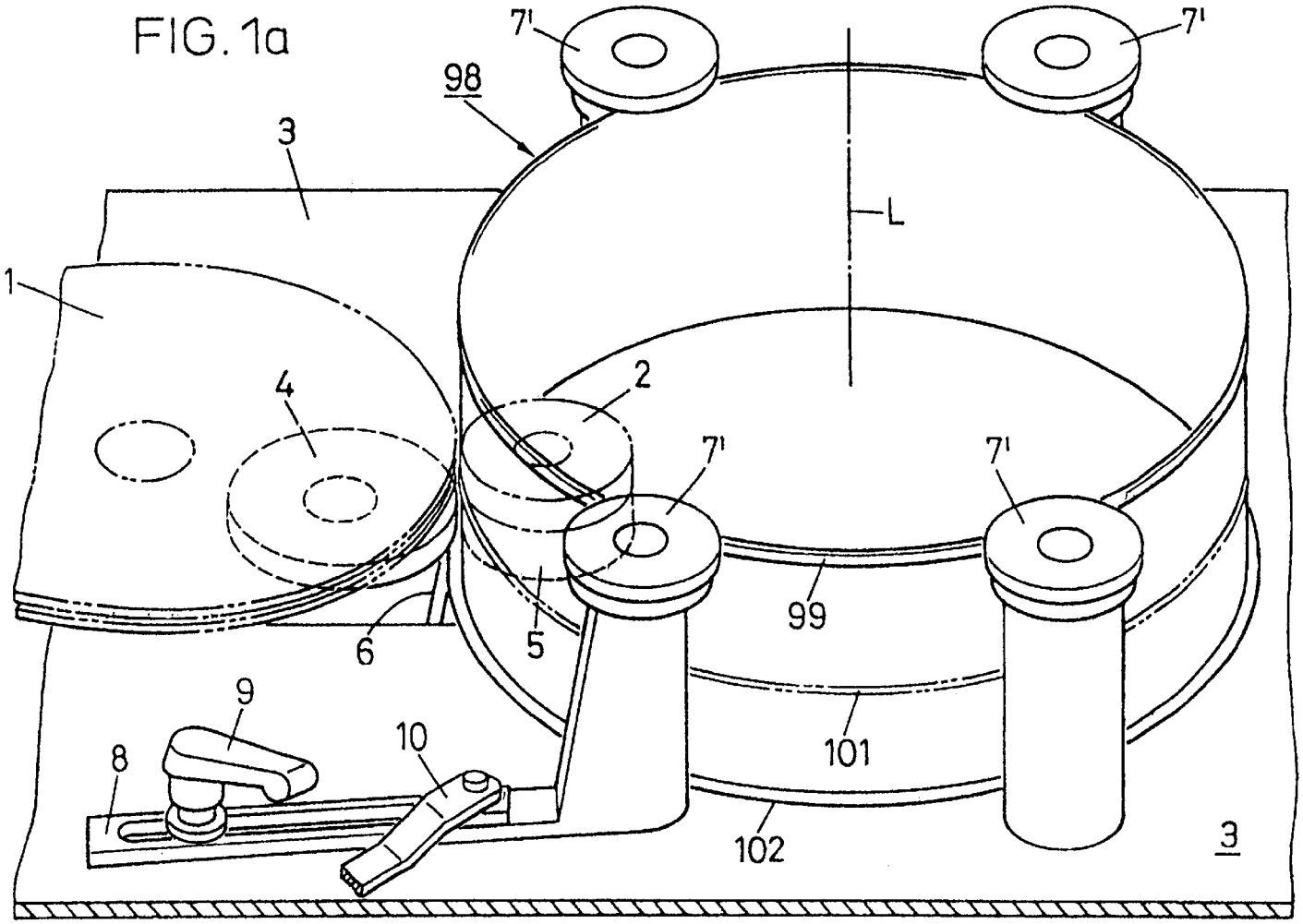
FIG. 1*a* is a perspective illustration of the folding/closing machine in the operation thereof on a sheet-metal ring.

Whereas the workpiece to be machined in FIG. 1 is an elongate pipe stub 100 or a pipe bend, a ring 98 is machined in FIG. 1*a*.

Guiding and pressing rollers 7' suitable for rings are mounted on the same support face 3 of the machine bed, it being preferable for two to be mounted fixed and two further ones to be displaceable on clamping rails 8 and fixed by way of clamping levers 9 and held laterally by braces 10.

In a further variant (not shown here) the adjustable guiding and pressing rollers 7 and 7' respectively are connected by way of the clamping rails thereof to the shaping-roller slide 51 described below, FIG. 4 and FIG. 5, which is used to facilitate manipulation when inserting and removing the workpiece.

In the present case the beading and delivery roller 1 is optional and is illustrated accordingly, and likewise the bead 101, as it is possible to dispense with it since the guiding and pressing rollers 7' guide the ring 98 securely when screwed on as shown.

As shown in FIG. 1*a*, pre-fabricated rings 98 can be used which already have an annular fold 99 and comprise pipe collar 102.

In addition, an annular bead 101 can already be present, which, as customary, acts as a stop bead in pipe connections.

When rings 98 into which no bead 101 is impressed are machined, it is possible to dispense with the beading and delivery roller 1 and with the support roller 2, and this further facilitates the manipulation of the machine.

Figure 2:
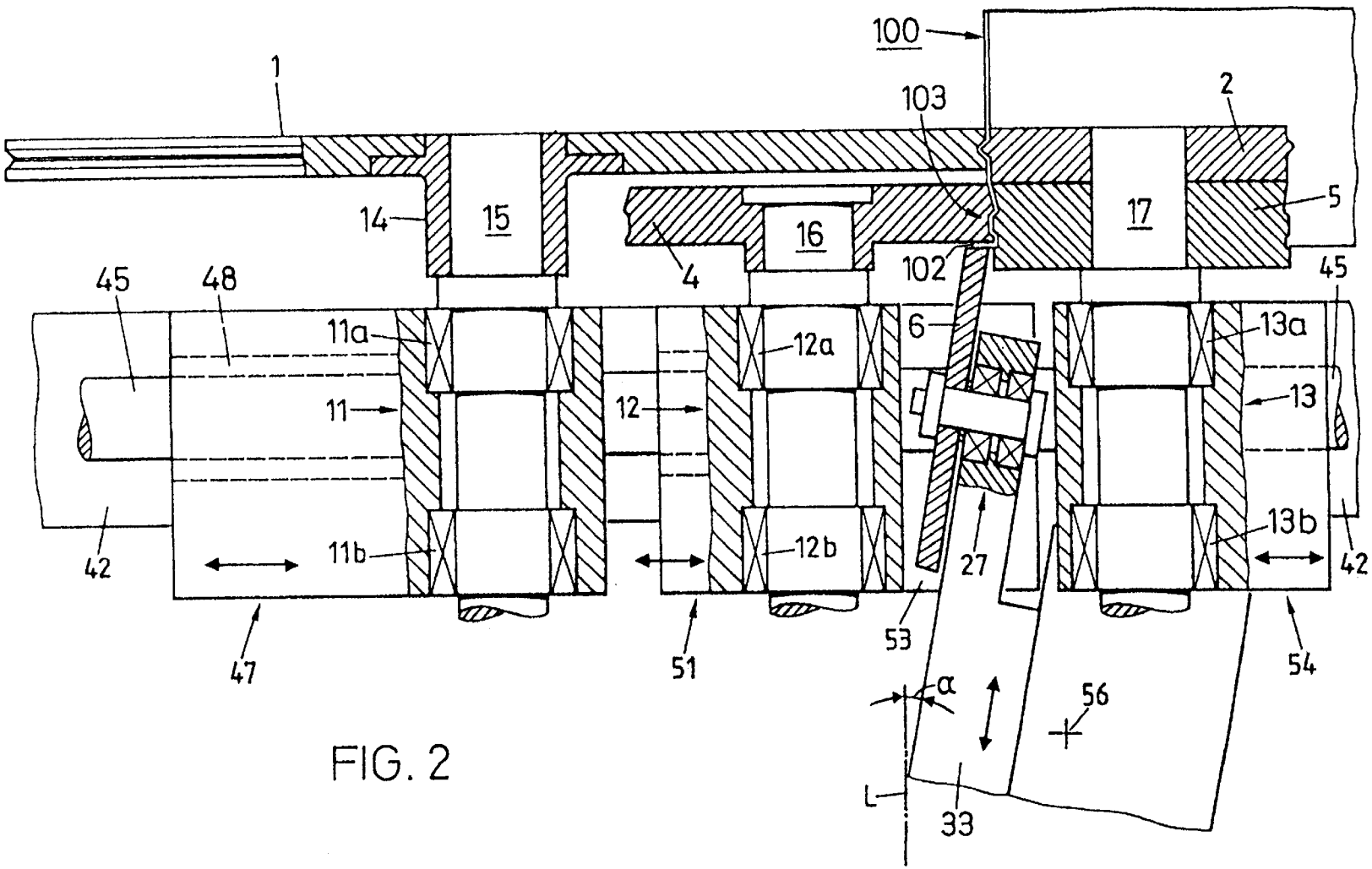
FIG. 2 is a partial sectional illustration of the rollers and wheels from FIG. 1, with their bearing points and the closing-wheel slide.

The individual rollers and the drives of the arrangements according to FIG. 1 and FIG. 1*a* may be seen in greater detail in their operation in FIG. 2.

It may be clearly seen that the shape 103 for a positively locking clamping of the seal is formed on the pipe member 100 by the partially concave shaping roller 5 and the partially convex shaping roller 4 cooperating therewith an an opposed manner. In this case the a beading and delivery roller 1 again provides for the parallel guidance of the pipe member 100 on its bead 101, FIG. 1, and prevents the workpiece from being displaced or lifted off.

This beading and delivery roller 1 is mounted on a suitable hub 14, with a drive shaft 15 which in turn is guided in a front and a rear roller bearing 11*a* and 11*b* respectively of a beading-roller mounting 11.

The beading-roller mounting 11 is a component of a beading-roller slide 47 which is provided with ball boxes 48, is mounted A on a front and a rear guide shaft 45 and is guided parallel. FIGS. 4 and 5.

A shaping-roller slide 51 is arranged in a similar manner, in which case a shaping-roller mounting 12 is provided with roller bearings 12*a* and 12*b* and carries the shaping roller 4 on a drive shaft 16.

The support roller 2 and the shaping roller 4 are mounted on a common drive shaft 17, with roller bearings 13*a*, 13*b*, in a shaping-roller mounting 13, which are likewise displaceable on guide shafts. One continuous guide shaft 45 projecting from the shaping-roller mounting 13 may be seen in FIG. 2. The whole is arranged in an adjustable shaping-roller support 54.

The closing wheel 6 is orientated at an acute angle $\alpha$ to the perpendicular L, in a closing-wheel slide 33, with a closing-wheel mounting 27. The closing-wheel slide 33 can be adjusted in the angular position $\alpha$ thereof with respect to the perpendicular L about a pivot shaft 56 and is displaceable hydraulically in the direction of the arrow.

Figure 3:
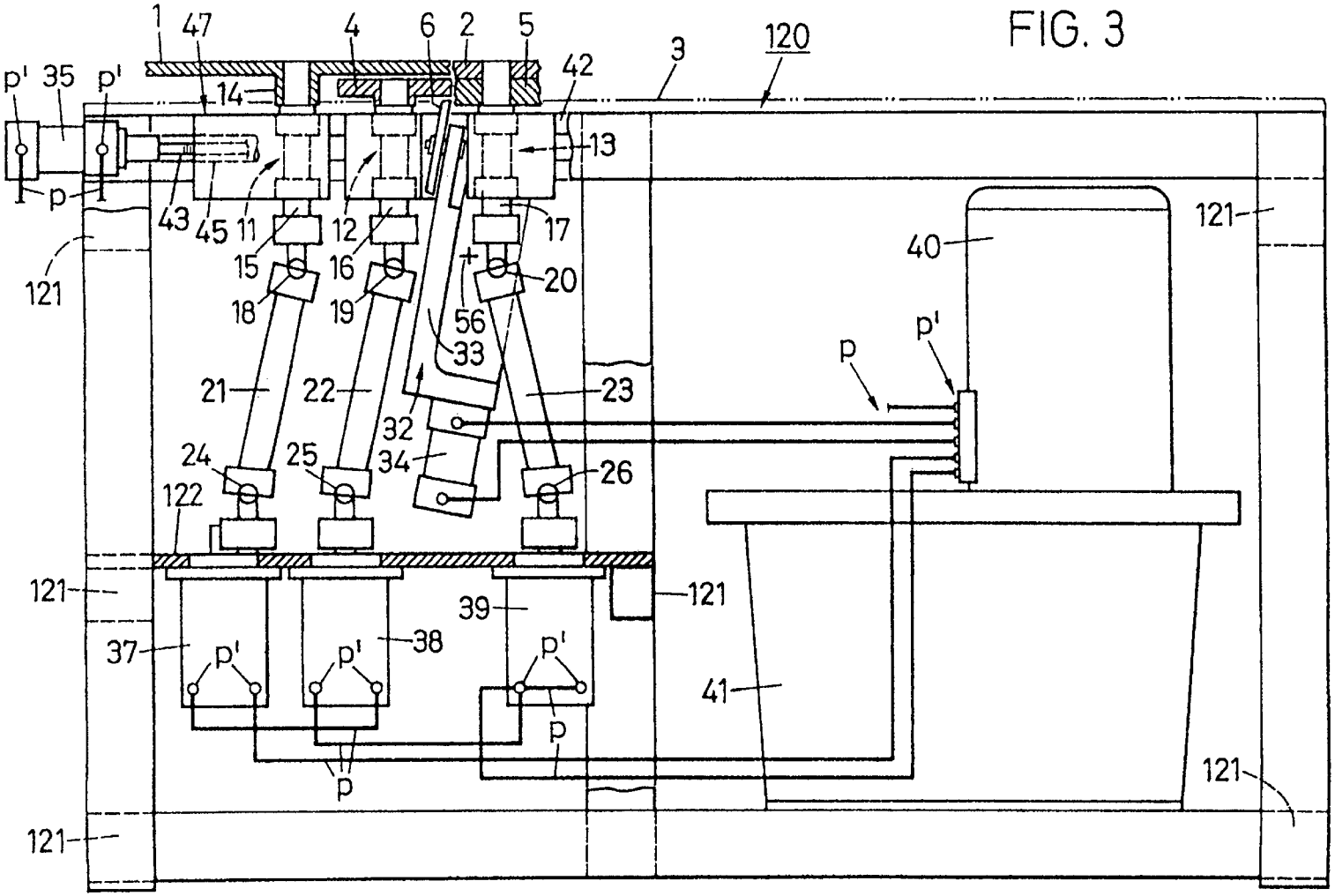
FIG. 3 is a simplified illustration of the machine stand of the folding/closing machine with the components contained therein, in a view from the front.

The devices described above are arranged in a machine stand 120, FIG. 3, which has cross members 121 for reinforcement purposes and receives the entire drive unit. The latter primarily comprises an hydraulic unit 40 with pressure oil connections p', pressure lines p for the hydraulic oil and three hydraulic motors 37 to 39 which are available commercially and which are flange-mounted on a lower mounting plate 122. The drive shafts 15 to 17 described in FIG. 3 are driven hydro-mechanically by way of universal drives 18 to 26, adjusted to one another. The corresponding universal joints are designated 18 to 20 at the top and 24 to 26 below. These joints are connected by way of intermediate shafts 21 to 23.

The necessary linear movements are produced by double-acting hydraulic cylinders likewise available commercially, and the beading-roller slide 47 is moved by an hydraulic cylinder 35, by way of its piston rod 43 provided with a thread; the closing-wheel slide 33 is moved by a further cylinder 34 flange-mounted on the oblique reciprocating drive 32.

The support face 3, which forms the machine bed, and the pivot axis 56 (illustrated in a simplified manner), which is used for setting the angle $\alpha$, FIG. 2, are likewise indicated.

Figure 4:
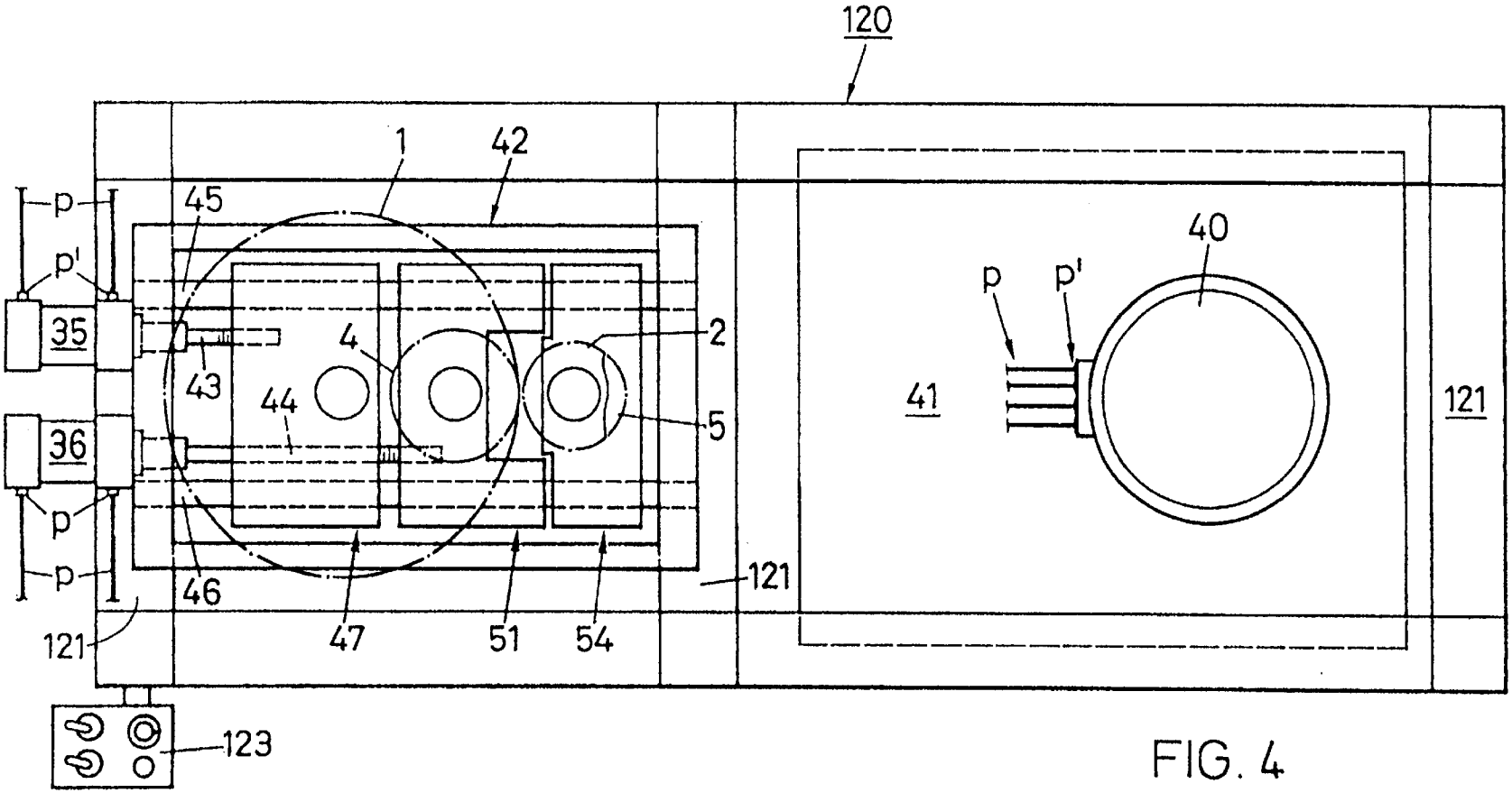
FIG. 4 is a simplified illustration of the machine stand in FIG. 3 in a view from above (plan view)

The plan view—likewise indicated in a simplified manner—of the flanging/closing and folding/closing machine, FIG. 4, shows the machine stand 120 with its cross members 121 in the uncovered state, i.e. without the support face/machine bed 3.

In this case the parallel guidance of the slides 47, 51 and 54 by means of guide shafts 45 and 46 in a fastening frame may be seen.

At the front the two hydraulic cylinders 35 and 36 may be seen adjacent to each other, the cylinder 35 engaging on the beading-roller slide 47 and the cylinder 36 by way of its piston rod 44 on the shaping-roller slide 51. The shaping-roller support 54 is adjustable manually by adjustment screws 55, FIG. 5, and is likewise guided on the shafts 45 and 46.

Figure 5:
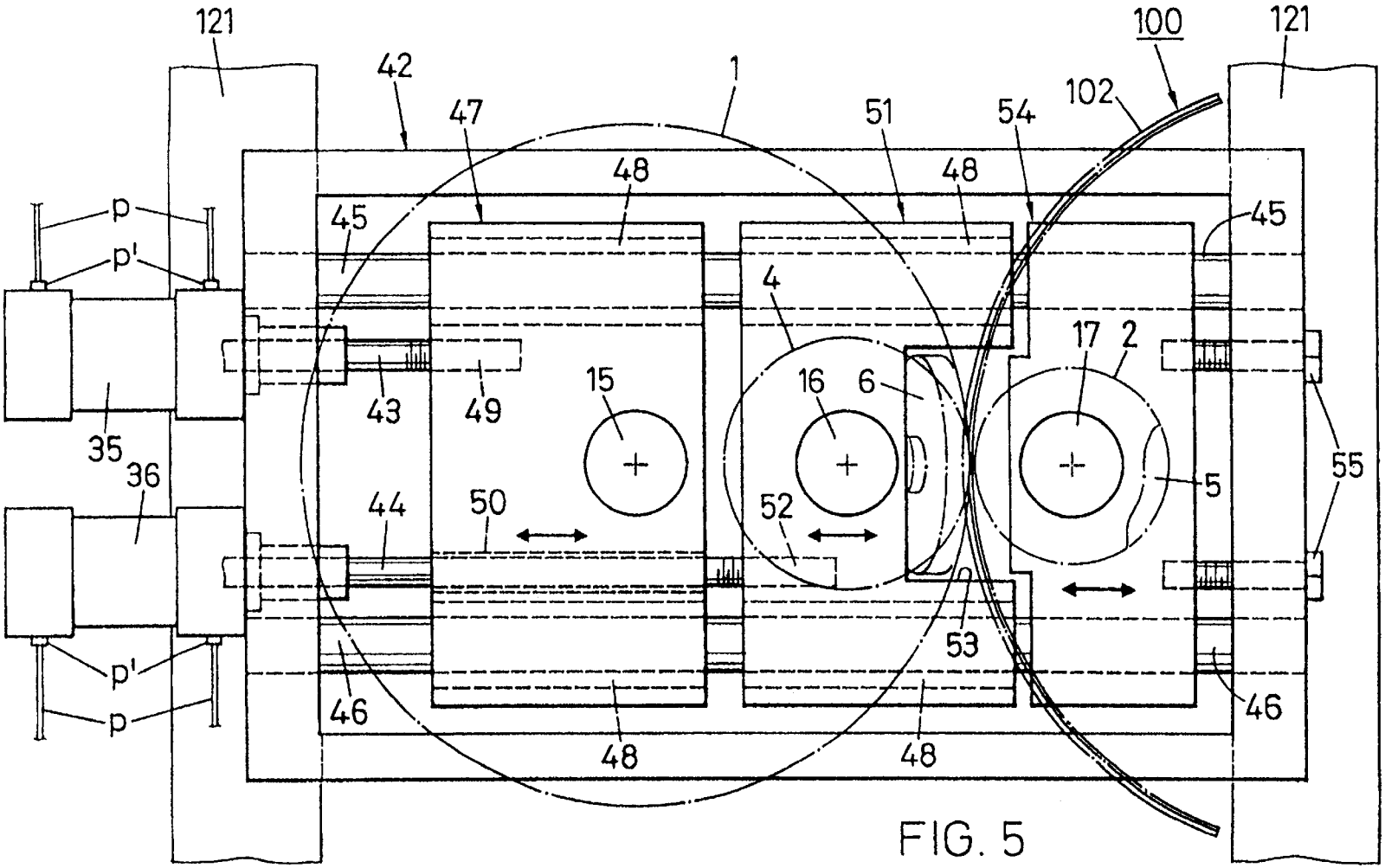
FIG. 5 is a cut-away enlargement of the illustration of FIG. 4, with additional details.

The starting positions of the slides 47, 51 are adapted to the workpiece, by rotating the threaded piston rods 43 and 44 in corresponding threads 49 and 52 disposed in the slides 57 and 51 respectively FIG. 5.

The rollers 1, 4, 2 and 5 are indicated with dash-dot lines; they are situated above the imaginary observer, above the removed machine bed.

A box-shaped control device 123, by way of which the operating steps are initiated in the machine, is situated on the right adjacent to the machine stand 120 and is connected thereto. On representational grounds the known safety devices and emergency cut-offs have not been indicated.

The hydraulic unit 40 with its pressure oil connections p' and pressure lines p may be seen in the right-hand part of FIG. 4. A rectangular oil tank 41 is situated thereunder.

The enlarged illustration of FIG. 5 shows the left-hand part of FIG. 4 with additional components. These are ball boxes 48, as well as the shaping-roller support 54 provided only with fitting bores and the through-bore 50 in the slide 47 and the thread 49 thereof indicated. In addition, an opening 53 may be seen in the shaping-roller slide 51 by which the closure wheel 6 can act from below upon the workpiece [and] the pipe stub 100 with its pipe collar 102.

FIGS. 6 to 8 enlarged once again show details of the closure wheel 6 with the freely rotating running shaft 28 thereof and the mounting 27 with the tapered roller bearings 27*a* and 27*b* of large dimensions in three different stages of engagement on the workpiece.

The closing wheel 6, with the bore 6*a* thereof, is raised slightly off the front tapered roller bearing 27*a* by a spacer ring 29 and is connected to the running shaft 28 in a manner preventing rotation by a groove nut 30 and an additional screw with a hexagon socket 31 and can be easily replaced.

Figure 6:
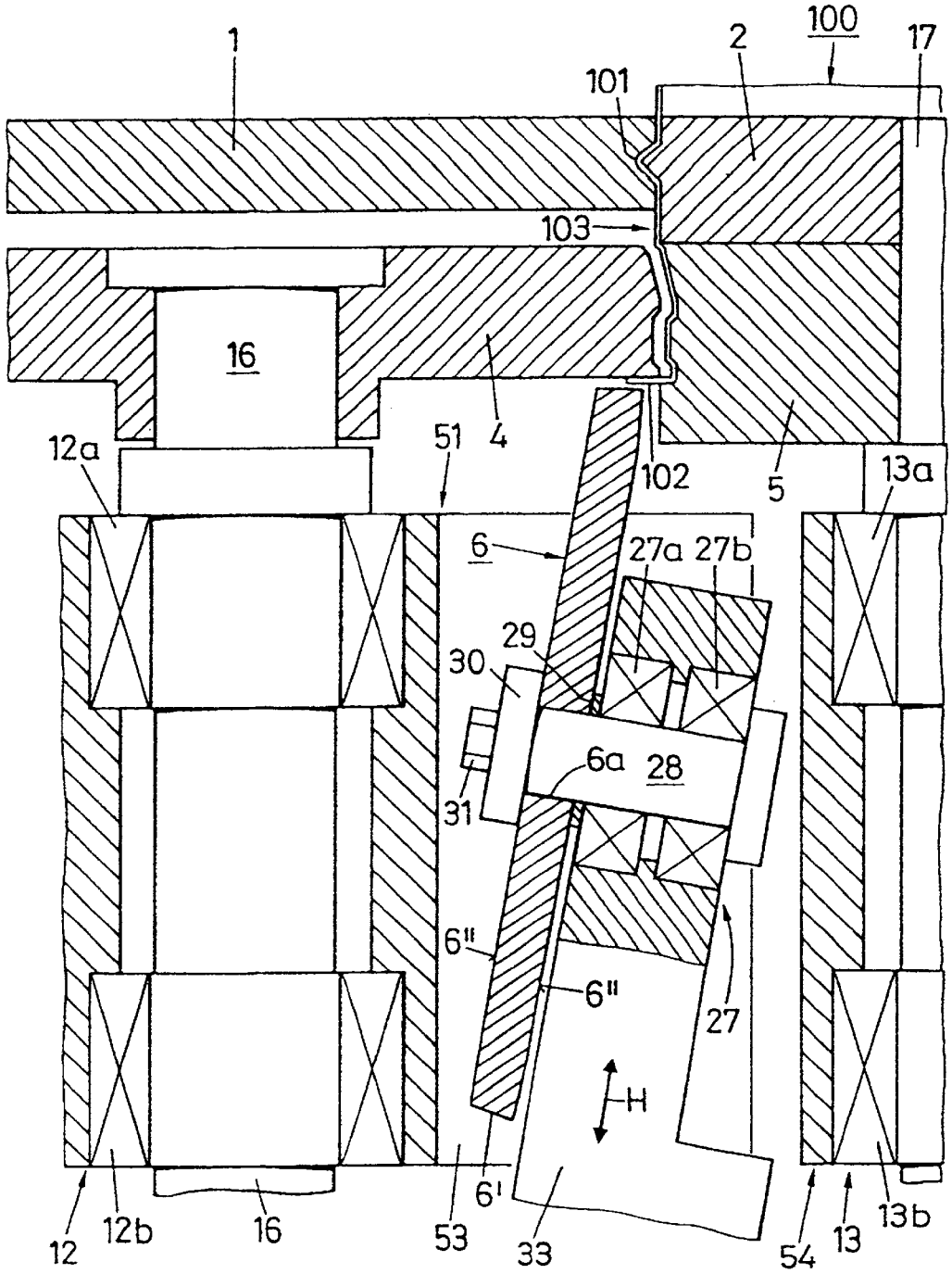
FIG. 6 is a partial sectional illustration of the closing wheel with the slide thereof in an operating position.

The shaping-roller slide 51, moving back horizontally in the direction of the arrow, after the formation of the pipe collar 102 and the region 103 is shown in FIG. 6. At the same time the closing-wheel slide 33 moves upwards in the reciprocating direction H.

Figure 7:
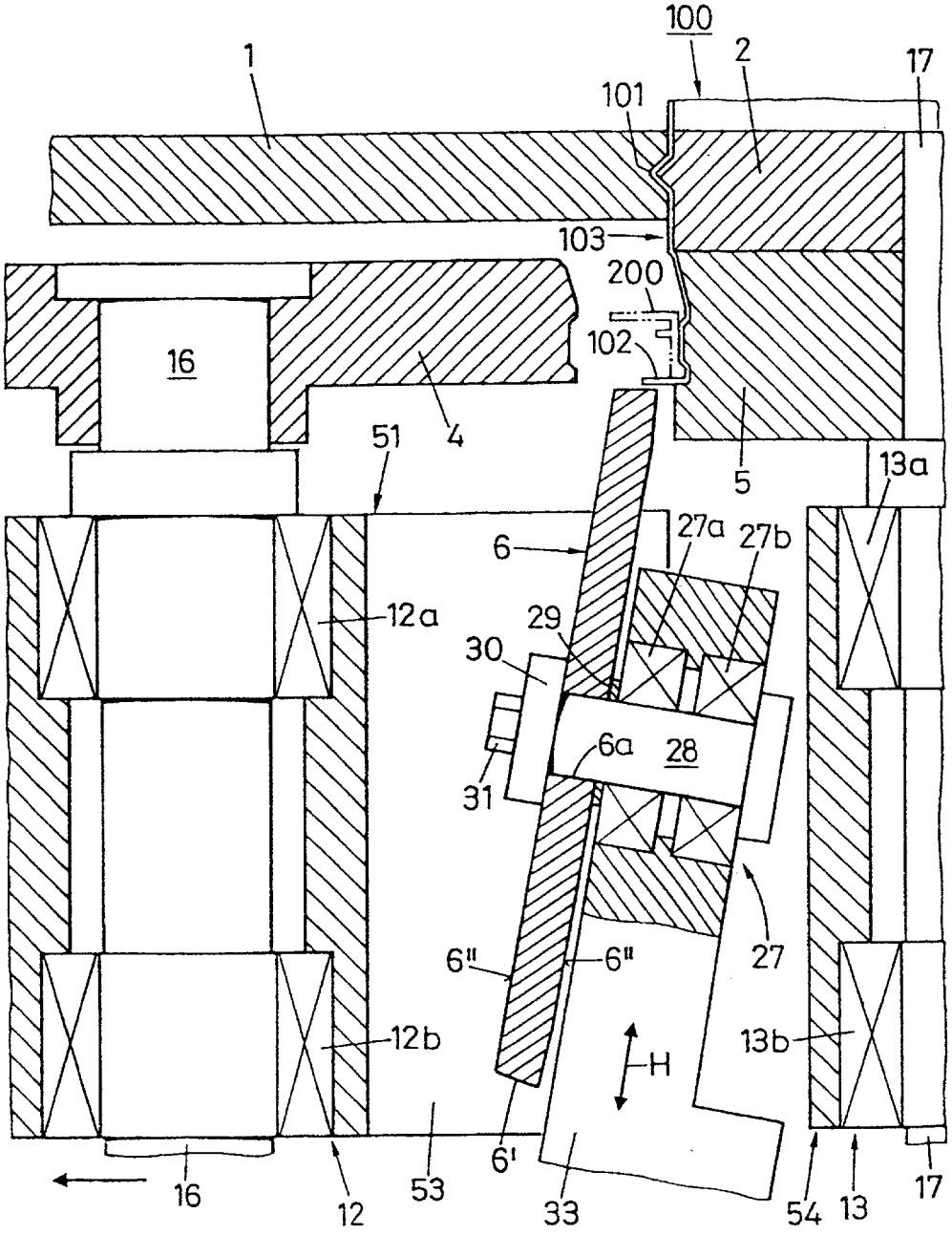
FIG. 7 is a partial sectional illustration of the closing wheel with the slide thereof in a further operating position.

FIG. 7 shows the shaping-roller slide 51 in the moved-back state, so that the end face of the closing wheel 6 can now engage on the pipe collar 102.

The annular seal 200 indicated in FIG. 7 has been inserted beforehand, i.e. positioned correctly and held in the region 103.

Figure 8:
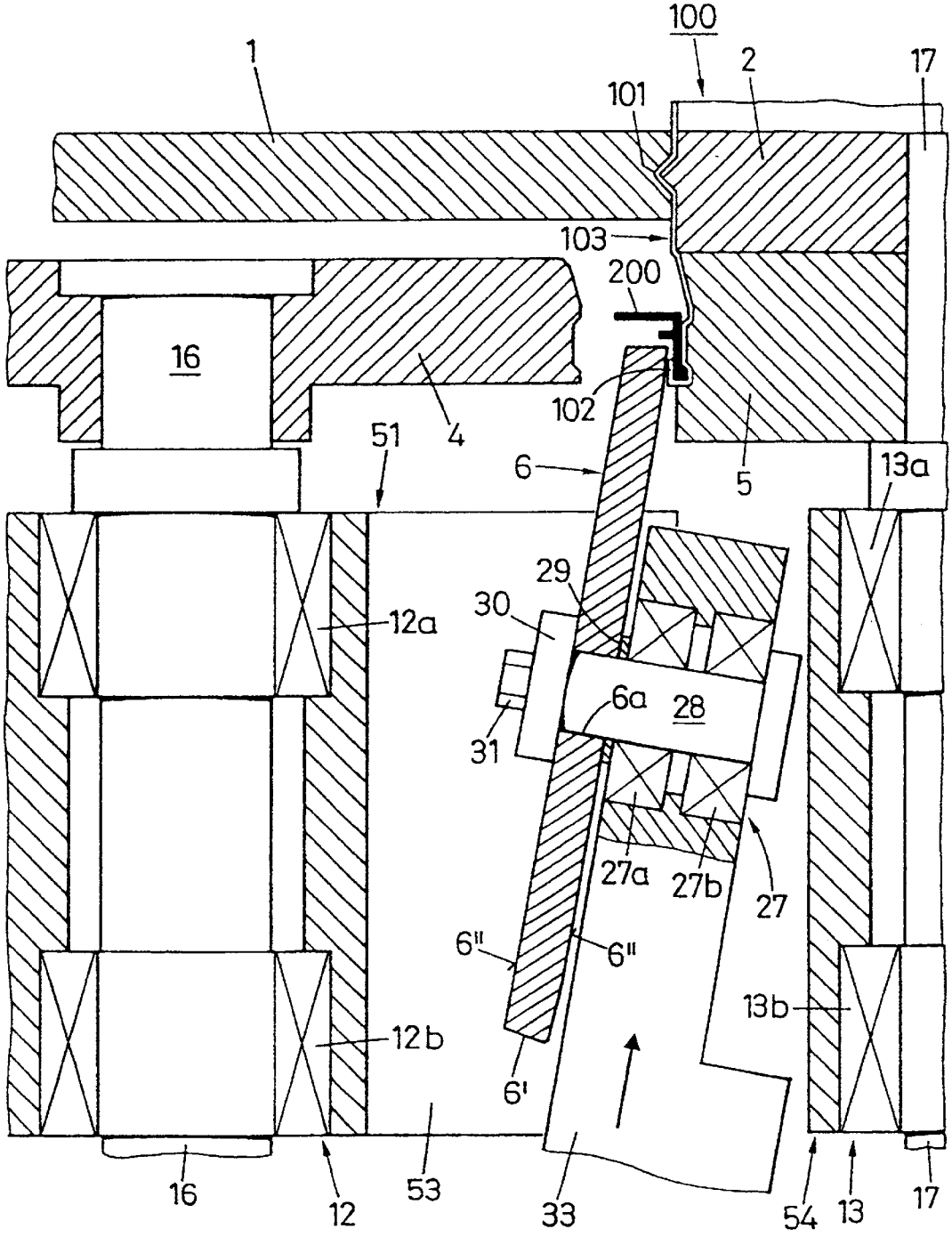
FIG. 8 is a partial sectional illustration of the closing wheel with the slide thereof in a third operating position.

In FIG. 8 the folding procedure with the positively locking retention of the seal 200 has already terminated; the closing-wheel slide 33 has reached the uppermost position thereof, and the seal 200 is tightly clamped.

During the entire procedure the pipe stub 100 is guided on the bead 101 between the beading and shaping roller 1 and the support roller 2 and is rotated about its axis of rotation by these driven rollers 1 and 2.

The appropriate design of the closing wheel 6 is crucially important for a correct folding.

Figure 9C:
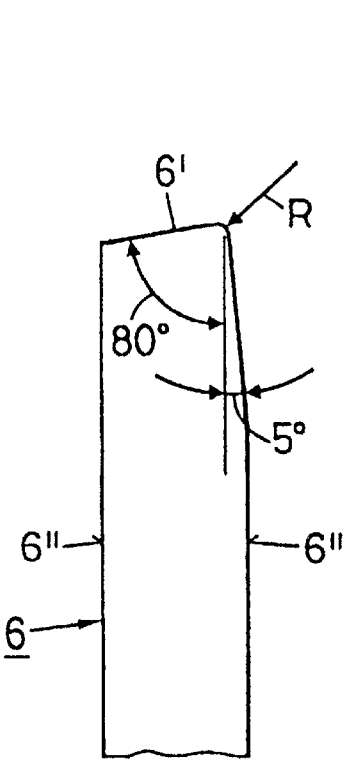
FIG. 9*c* shows the angle ratios on the closing wheel.
Figure 9B:
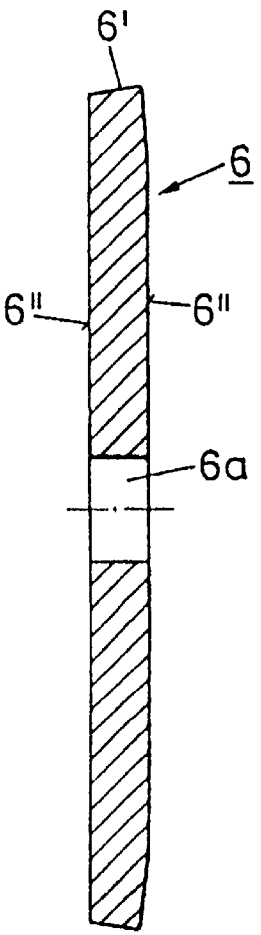
FIG. 9*b* is a sectional illustration of the closing wheel.
Figure 9A:
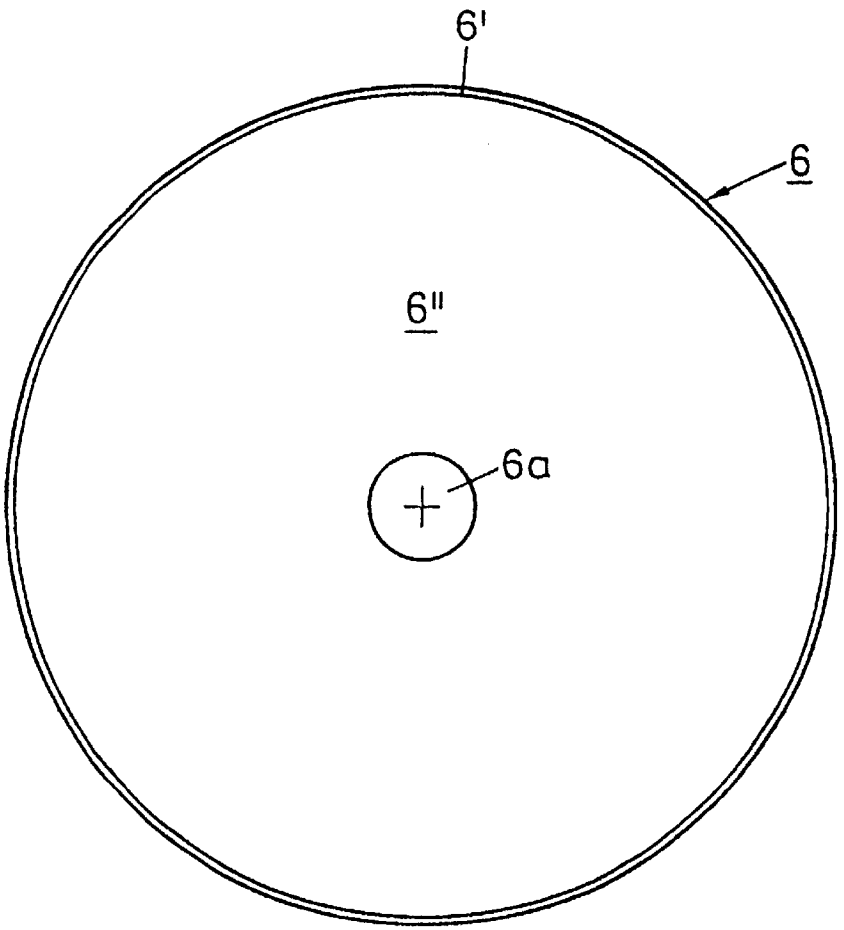
FIG. 9*a* is a plan view of the closing wheel.
Figure 10:
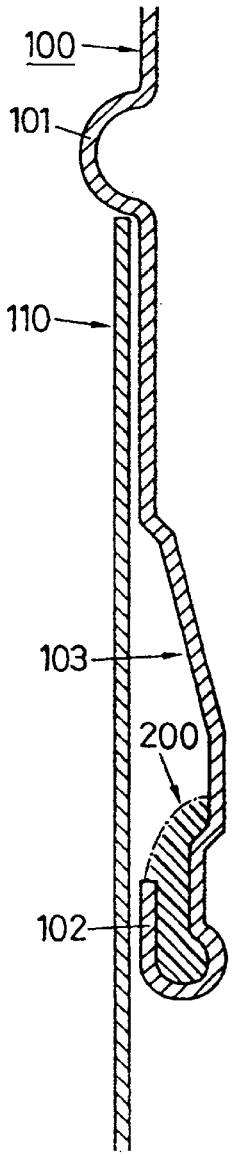
FIG. 10 is a sectional illustration of a pipe connection with the seal indicated.
Figure 11:
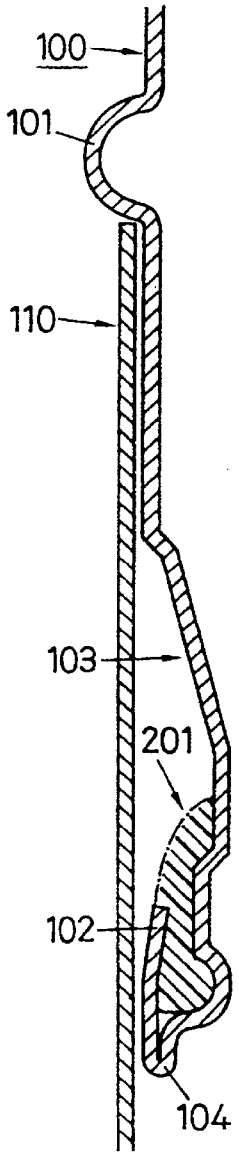
FIG. 11 is a further sectional illustration of a pipe connection with a seal, with the shape of the fold altered as compared with FIG. 10.
Figure 12:
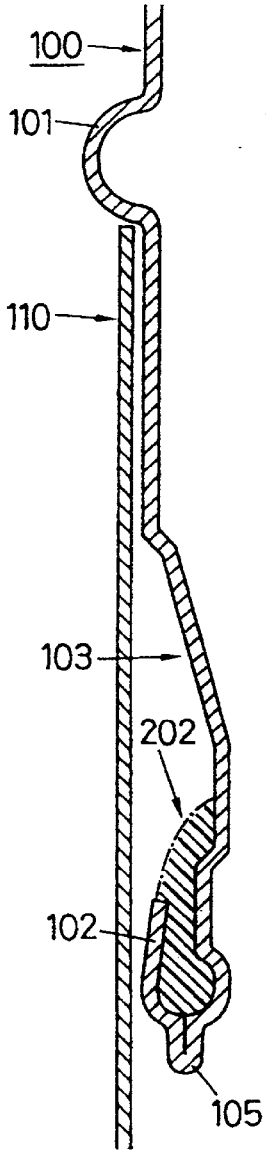
FIG. 12 is a third sectional illustration of a pipe connection with a seal, with the shape of the fold altered as compared with FIG. 11.

The closing wheel 6 is shown in plan view in FIG. 9*a*. The bore 6*a*, the end face 6' and a lateral face 6" are visible in this illustration.

The vertical sectional illustration of FIG. 9*b* shows the profile of the closing wheel 6. It is evident here that the left-hand lateral face 6" has a smaller diameter than the right-hand one. The obtuse angle formed as a result is indicated in FIG. 9*c* and amounts to 80°, measured with respect to the parallel part of the right-hand lateral face 6". An oblique portion of 5° is present in the peripheral region of the right-hand lateral face 6", the transition being provided with a rounding with the radius R.

If FIGS. 9*b* and 9*c* are observed in conjunction with FIG. 6 to FIG. 8, it may easily be seen that as the pipe collar 102 is closed the closing wheel 6 engages first with the end face 6', then with the region of the radius R and finally with the periphery of the right-hand lateral face 6". This functional procedure results in precise, positively locking folds, as desired in order to receive seals 200.

Because of the rolling and sliding engagement of the closing wheel 6, only minimal friction occurs on the workpiece, and this has a positive effect upon the coating and upon the wear of the closing wheel 6.

End parts of such seals 200 to 203 are illustrated by way of example in FIG. 10 to FIG. 13. In this case there are variations not only in the region 103, but also in the pipe collar, which can deteriorate [sic] as far as the double fold 104 or 105.

The bead 101 can likewise be shaped in various ways, as the above illustrations show.

In practical testing it has been found that the end parts of the seals 200 to 203 tend to give way on account of their resilience, so that it is recommended—on grounds of safety—to install a sliding finger which is actuated hydro-mechanically and which above the closing roller 6 holds the seal in its lowest position during closure.

The embodiment of a finger mentioned above or one or more small rollers depends to a large extent upon the selected shape of the seal and can be easily adapted to the subject of the invention.

Figure 13:
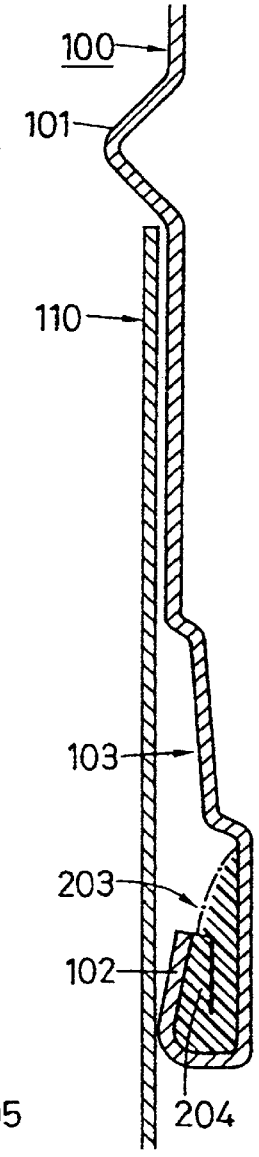
FIG. 13 is a fourth sectional illustration of a pipe connection with a seal, with the shape of the fold altered as compared with FIG. 10.

An additional lip 204, which allows a clamping improved still more as compared with the clamping parts 200 to 202, may be seen in the clamping part 203 in FIG. 13, as shown by the sectional illustration—likewise truncated in this case—of the sealing ring.

It has been found in practice that in particular rubber seals with a second lip 204—cf. FIG. 13—have a pronounced tendency to spring in and so require a reinforced clamping. A further closing wheel as shown in FIG. 14*a* and FIG. 14*b* has therefore been provided which on account of its shape, the delivery path and the dynamic properties of the folding/closing machine results in a particularly strong immovable clamping of the bulky seal.

Figure 14B:
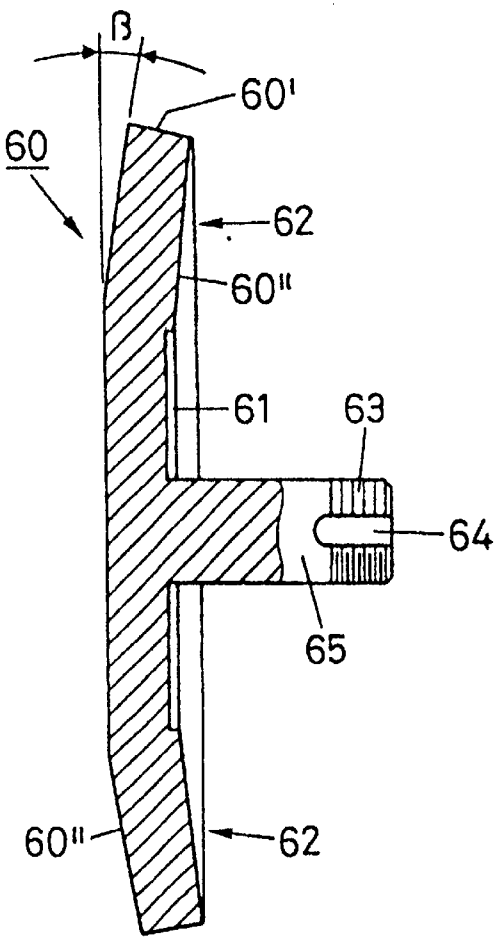
FIGS. 14*a* and 14*b* show a preferred closing wheel for a strong clamping of seals.
Figure 14A:
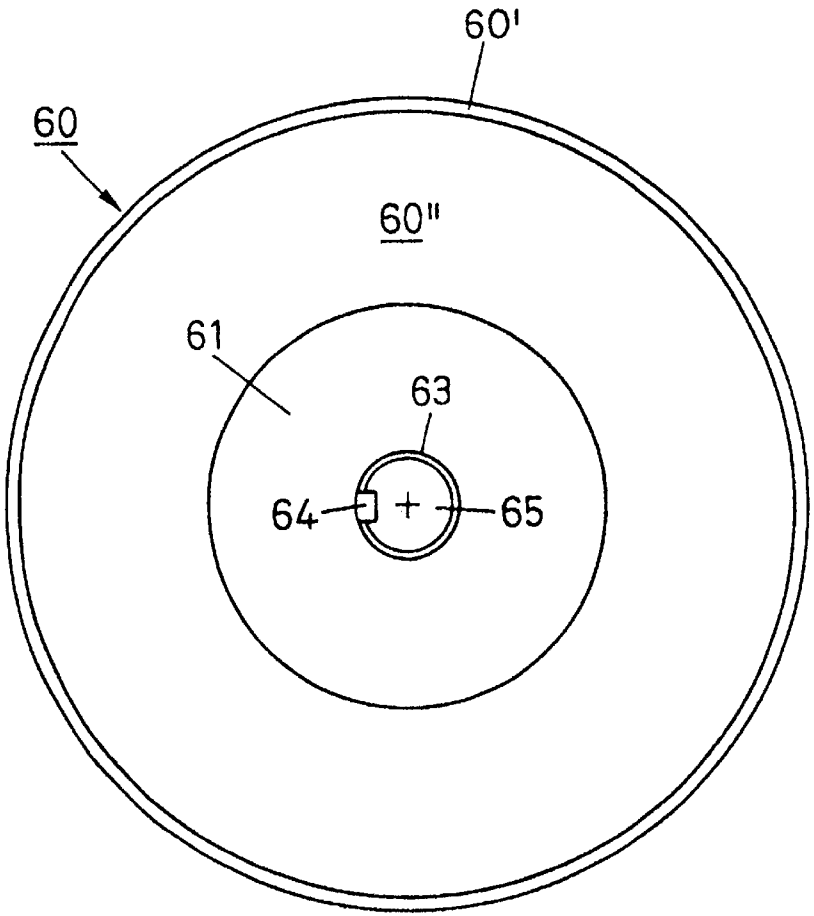

It may be seen from FIG. 14*a* in conjunction with FIG. 14*b* that this closing wheel, designated 60, is shaped in the form of a plate and has lateral faces 60" bent over at an angle β of 20°. In addition, an end face 60', a recess 61, a shaft 65 with a thread 63 at the end, and a keyway 64 formed therein may be seen.

Figure 15:
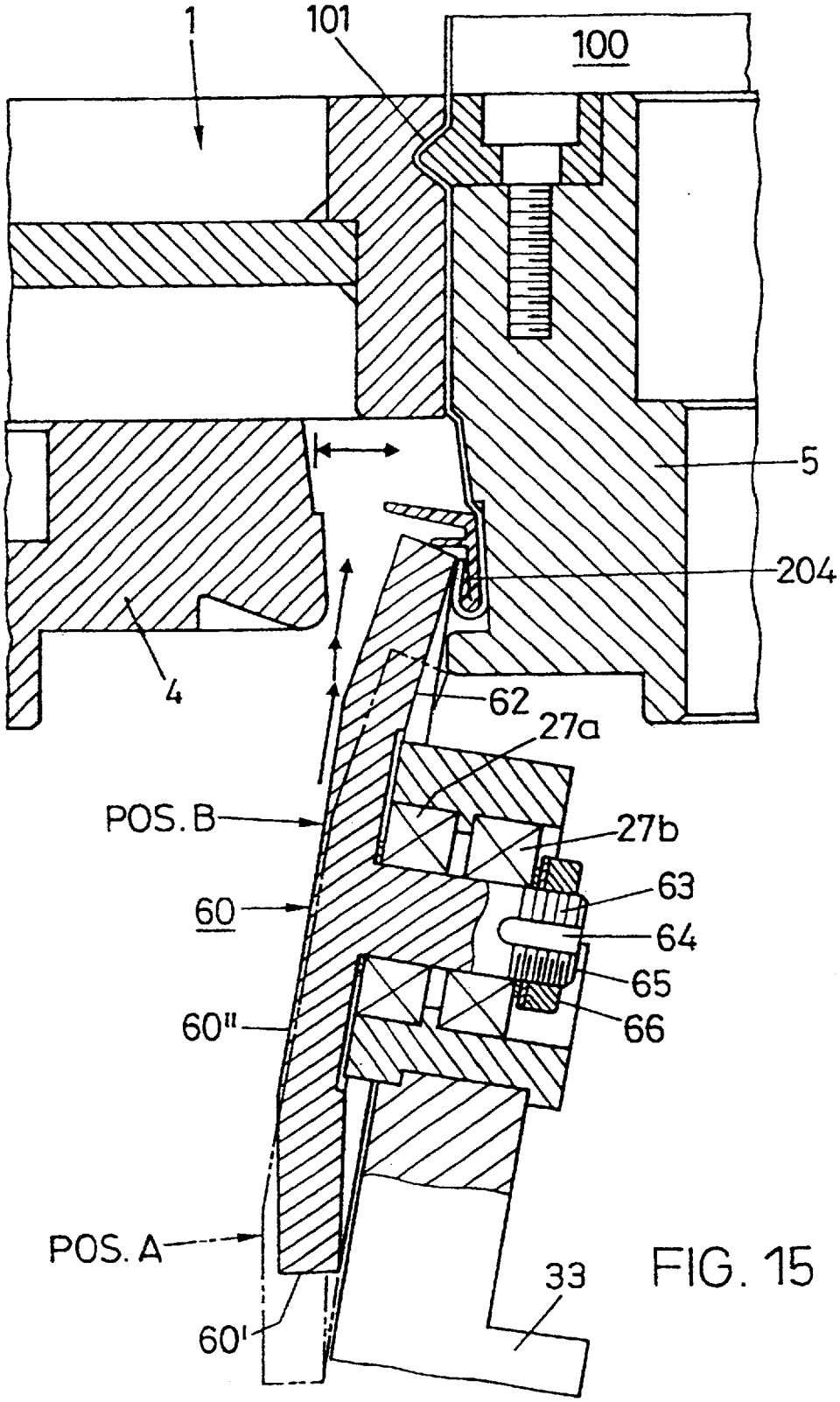
FIG. 15 shows the preferred closing wheel in use, illustrated in the two end positions thereof.

The illustration of FIG. 15 which is analogous to FIGS. 6 to 8 shows the closing wheel 60 engaging with the bent-over portion 62 in the form of a plate. In this case it is evident that when the shaping roller 4 is moved out—symbolized by a horizontally bounded arrow—the closing wheel 60 is deflected during its upward movement.

This polygonal path produced in part kinematically and in part by deflexion at the bearing points 27*a*, 27*b*, 33 is indicated by corresponding arrows parallel to the closing wheel 60.

In this case the starting position of the closing wheel 60 is indicated with dash-dot lines as position A, whereas the position B shows the closing wheel indicated with solid lines in its end position.

The closing wheel 60 is fixed in a manner known per se by a lock nut 63.

It has been found that as a result of this arrangement even seals provided with lubricants or talcum and having thick clamping parts 204 can be processed without difficulty and remain immovable even under rough assembly conditions.

In principle, the flanging and folding/closing machine has dimensions and power which can even be utilized at building sites. In order to ensure a completely autonomous operation there, a set of rollers adapted to the diameters of the prescribed ventilation pipes is sufficient. In addition, it is recommended that threaded bores should be provided on a plurality of partial circles in the support face/machine bed, in order that the stationary guiding and pressing rollers can be screwed in there.

What is claimed is:

1. A flanging and/or folding/closing machine for forming and for closing fold connections in the production of pipes and of pipe connections and bends comprising segments, wherein the machine contains a rotatably mounted beading and delivery roller, a support roller and a rotatably mounted closing wheel, wherein the closing wheel arranged in a closing-wheel slide forms an acute angle with a support face of the support roller and engages on a pipe stub or ring, characterized in that the closing-wheel slide is situated below the support face and forms an angle ($\alpha$) of less than 35° with the perpendicular (L), the closing wheel mounted in the slide has a smaller diameter on one lateral face (6") thereof remote from the support roller than on the other lateral face (6") facing the support roller, so that an obtuse angle is formed between the said one lateral face (6") and the end face (6') of the closing wheel (6), and the region between the end face (6') and the periphery to the support roller is provided with a radius (R).

2. A flanging and folding/closing machine according to claim 1, characterized in that a pivot axis, about which the angle ($\alpha$) can be set and fixed, is provided in the closing-wheel slide.

3. A flanging and folding/closing machine according to claim 1, characterized in that the closing-wheel slide forms an angle ($\alpha$) of from 8° to 12° or from 20° to 30° with the perpendicular (L).

4. A flanging and folding/closing machine according to claim 1, characterized in that the lateral face (60") of the closing wheel facing the support roller is bent over an angle ($\beta$).

5. A flanging and folding/closing machine according to claim 1, characterized in that a beading and delivery roller with a concave recess is arranged parallel to the support face pressing and guiding the pipe stub on a bead against at least one convex support roller in the interior of the pipe stub, wherein the rollers are driven by a motor on both sides and run in the same direction as each other on their periphery.

6. A flanging and folding/closing machine according to claim 5, characterized in that the individual wheels and rollers are driven by way of universal drives and hydraulic drive motors.

7. A flanging and folding/closing machine according to claim 5, characterized in that further support rollers are provided which are designed to be jointly rotatable and abut in the interior of the pipe stub.

8. A flanging and folding/closing machine according to claim 5, characterized in that it has a convex shaping roller and the convex shaping roller adapted to a shaping roller and spaced therefrom, wherein the convex shaping roller is situated at a level above the support face which corresponds to the mass of the fold to be produced.

9. A flanging and folding/closing machine according to claim 5, characterized in that an hydraulic unit, supplying the hydraulic cylinders and the drive motors, is arranged in the machine stand.

10. A flanging and folding/closing machine according to claim 1, characterized in that a holding-down means (7') with cylindrical rollers is provided and guides a ring in the perpendicular (L) in a slidable manner on the support face.

11. A method of flanging and closing folds with a flanging and folding/closing machine, for forming and closing fold connections in the production of pipes and of pipe connections and bends comprising segments, wherein the machine contains a rotatably mounted beading and delivery roller, a support roller and a rotatably mounted closing wheel, wherein the closing wheel arranged in a closing-wheel slide forms an acute angle with a support face of the support roller and engages on a ring, wherein the closing wheel has a smaller diameter on one lateral face thereof remote from the support roller than on the other lateral face facing the support roller, so that an obtuse angle is formed between the said one lateral, face and the end face of the closing wheel, and wherein the region between the end face and the periphery to the support roller is provided with a radius, comprising the steps:

in a first method step clamping the ring on the support face by means of holding-down means;

in a second method step forming a flange with a rounded attachment by delivery of offset shaping rollers;

and in a third method step advancing the closing-wheel slide from below to the flange situated thereabove, wherein the end face of the closing wheel is the operating face at the beginning of closure, and the closing-wheel slide is advanced further until the fold rests against the ring and secures an inserted seal.

12. A method according to claim 11, characterized in that during the third method step the inserted sealing strip is held in the lower position thereof by means of a sliding finger or at least one roller.

13. A method of flanging and closing folds on pipe segments and in bend segments with a flanging and folding/closing machine, for forming and closing fold connections in the production of pipe connections and bends comprising segments, wherein the machine contains a rotatably mounted beading and delivery roller, a support roller and a rotatably mounted closing wheel, and wherein the closing wheel arranged in a closing-wheel slide forms an acute angle with a support face of the support roller and engages on a pipe stub, wherein the closing wheel has a smaller diameter on one lateral face thereof remote from the support roller than on the other lateral face facing the support roller, so that an obtuse angle is formed between the said one lateral face and the end face of the closing wheel, and wherein the region between the end face and the periphery to the support roller is provided with a radius, comprising the steps:

in that in a first method step impressing a continuous bead in an end piece of a pipe stub;

in a second method step forming a flange with a rounded attachment by delivery of the offset shaping rollers; and in a third method step advancing the closing-wheel slide from below to the flange situated thereabove, wherein the end face of the closing wheel is the operating face at the beginning of closure, and the closing-wheel slide is advanced further until the fold rests against the pipe member and secures an inserted sealing strip.

14. A method according to claim 13, characterized in that during method steps 2 and 3 the beading and delivery roller engages and so the workpiece is guided axially and laterally.

15. A method according to claim 13, characterized in that during the third method step the inserted sealing strip is held in the lower position thereof by means of a sliding finger or at least one roller.

16. A method of flanging and closing folds with a flanging and folding/closing machine, for forming and closing fold connections in the production of pipes and of pipe connections and bends comprising segments, wherein the machine contains a rotatably mounted beading and delivery roller, a support roller and a rotatably mounted closing wheel, wherein the closing wheel arranged in a closing-wheel slide forms an acute angle with a support face of the support roller and engages on a ring, wherein the closing wheel has a smaller diameter on one lateral face thereof remote from the support roller than on the other lateral face facing the support roller, so that an obtuse angle is formed between the said one lateral face and the end face of the closing wheel, and wherein the region between the end face and the periphery to the support roller is provided with a radius, and a beading and delivery roller with a concave recess is arranged parallel to the support face pressing and guiding the pipe stub on a bead against at least one convex support roller in the interior of the pipe stub, wherein the rollers are driven by a motor on both sides and run in the same direction as each other on their periphery, the method comprising the steps:

in a first method step clamping the ring on the support face by means of holding-down means;

in a second method step forming a flange with a rounded attachment by delivery of offset shaping rollers; and in a third method step advancing the closing-wheel slide from below to the flange situated thereabove, wherein the end face of the closing wheel is the operating face at the beginning of closure, and the closing-wheel slide is advanced further until the fold rests against the ring and secures an inserted seal.

17. A method of flanging and closing folds with a flanging and folding/closing machine, for forming and closing fold connections in the production of pipes and of pipe connections and bends comprising segments, wherein the machine contains a rotatably mounted beading and delivery roller, a support roller and a rotatably mounted closing wheel, wherein the closing wheel arranged in a closing-wheel slide forms an acute angle with a support face of the support roller and engages on a ring, wherein the closing wheel has a smaller diameter on one lateral face thereof remote from the support roller than on the other lateral face facing the support roller, so that an obtuse angle is formed between the said one lateral face and the end face of the closing wheel, and wherein the region between the end face and the periphery to the support roller is provided with a radius, and a beading and delivery roller with a concave recess is arranged parallel to the support face pressing and guiding the pipe stub on a bead against at least one convex support roller in the interior of the pipe stub, wherein the rollers are driven by a motor on both sides and run in the same direction as each other on their periphery, and further the support rollers are provided which are designed to be jointly rotatable and abut in the interior of the pipe stub comprising the steps:

in a first method step clamping the ring on the support face by means of holding-down means;

in a second method step forming a flange with a rounded attachment by delivery of offset shaping rollers; and in a third method step advancing the closing-wheel slide is advanced from below to the flange situated thereabove, wherein the end face of the closing wheel is the operating face at the beginning of closure, and the closing-wheel slide is advanced further until the fold rests against the ring and secures an inserted seal.

18. A method of flanging and closing folds on pipe segments and in bend segments with a flanging and folding/closing machine, for forming and closing fold connections in the production of pipe connections and bends comprising segments, wherein the machine contains a rotatably mounted beading and delivery roller, a support roller and a rotatably mounted closing wheel, and wherein the closing wheel arranged in a closing-wheel slide forms an acute angle with a support face of the support roller and engages on a pipe stub, wherein the closing wheel has a smaller diameter on one lateral face thereof remote from the support roller than on the other lateral face facing the support roller, so that an obtuse angle is formed between the said one lateral face and the end face of the closing wheel, and wherein the region between the end face and the periphery to the support roller is provided with a radius, and wherein a beading and delivery roller with a concave recess is arranged parallel to the support face pressing and guiding the pipe stub on a bead against at least one convex support roller in the interior of the pipe stub, wherein the rollers are driven by a motor on both sides and run in the same direction as each other on their periphery, and further support rollers are provided which are designed to be jointly rotatable and abut in the interior of the pipe stub the method comprising the steps:

in a first method step impressing a continuous bead in an end piece of a pipe stub;

in a second method step forming a flange with a rounded attachment by delivery of the offset shaping rollers; and in a third method step advancing the closing-wheel slide is advanced from below to the flange situated thereabove, wherein the end face of the closing wheel is the operating face at the beginning of closure, and the closing-wheel slide is advanced further until the fold rests against the pipe member and secures an inserted sealing strip.

19. A method of flanging and closing folds on pipe segments and in bend segments with a flanging and folding/closing machine, for forming and closing fold connections in the production of pipe connections and bends comprising segments, wherein the machine contains a rotatably mounted beading and delivery roller, a support roller and a rotatably mounted closing wheel, and wherein the closing wheel arranged in a closing-wheel slide forms an acute angle with a support face of the support roller and engages on a pipe stub, wherein the closing wheel has a smaller diameter on one lateral face thereof remote from the support roller than on the other lateral face facing the support roller, so that an obtuse angle is formed between the said one lateral face and the end face of the closing wheel, and wherein the region between the end face and the periphery to the support roller is provided with a radius, a beading and delivery roller with a concave recess is arranged parallel to the support face pressing and guiding the pipe stub on a bead against at least one convex support roller in the interior of the pipe stub, wherein the rollers are driven by a motor on both sides and run in the same direction as each other on their periphery comprising the steps of:

in a first method step impressing a continuous bead in an end piece of a pipe stub;

in a second method step forming a flange with a rounded attachment by delivery of the offset shaping rollers; and in a third method step advancing the closing-wheel slide from below to the flange situated thereabove, wherein the end face of the closing wheel is the operating face at the beginning of closure, and the closing-wheel slide is advanced further until the fold rests against the pipe member and secures an inserted sealing strip.

* * * * *

UNITED STATES PATENT AND TRADEMARK OFFICE

CERTIFICATE OF CORRECTION

PATENT NO. : 6,598,285 B1
DATED : July 29, 2003
INVENTOR(S) : Rudolf Binggeli et al.

It is certified that error appears in the above-identified patent and that said Letters Patent is hereby corrected as shown below:

Title page,
Item [57], ABSTRACT,
Line 5, "rechecked" should read -- rechucked --;

Column 1,
Line 4, insert the following heading, -- BACKGROUND OF THE INVENTION --;

Column 4,
Line 14, "the a beading" should read -- the beading --; and
Line 24, "mounted A on a" should read -- mounted on a --.

Signed and Sealed this

Twenty-fourth Day of February, 2004

JON W. DUDAS
*Director of the United States Patent and Trademark Office*